United States Patent [19]

Re

[11] 4,373,502

[45] Feb. 15, 1983

[54] FUEL CONTROL SYSTEM

[75] Inventor: Ronald Re, Newark, Del.

[73] Assignee: Miletech, Inc., Greenville, Del.

[21] Appl. No.: 244,067

[22] Filed: Mar. 16, 1981

Related U.S. Application Data

[63] Continuation-in-part of Ser. No. 197,695, Oct. 16, 1980, abandoned.

[51] Int. Cl.[3] ..... E02M 7/22

[52] U.S. Cl. ..... 123/512; 261/51; 261/68; 261/DIG. 38; 261/5; 261/37

[58] Field of Search ..... 261/51, 68, 70, DIG. 38, 261/37, 5; 123/511, 512

[56] References Cited

U.S. PATENT DOCUMENTS

| | | | |
|---|---|---|---|
| 1,269,787 | 6/1918 | Church | 123/510 |
| 1,363,694 | 12/1920 | Tampier | 123/510 |
| 1,594,705 | 8/1926 | Beatson | 123/510 |
| 1,994,944 | 3/1935 | Cole | 261/51 |
| 2,362,145 | 11/1944 | Mallory | 261/51 |
| 2,600,650 | 6/1952 | Hieger | 261/69 R |
| 2,618,473 | 11/1952 | Whitford | 261/DIG. 38 |
| 2,633,146 | 3/1953 | Witt | 261/70 |
| 2,679,388 | 5/1954 | Rector | 261/51 |
| 2,735,665 | 2/1956 | Lance | 261/27 |
| 2,749,894 | 6/1956 | Sariti | 261/DIG. 19 |
| 2,828,115 | 3/1958 | Register | 261/51 |
| 2,955,615 | 7/1956 | Miller | 123/325 |
| 3,151,604 | 10/1964 | Walker | 261/DIG. 19 |
| 3,343,820 | 9/1967 | Elliott | 261/51 |
| 3,368,801 | 2/1968 | Brunner | 261/70 |
| 3,409,277 | 11/1968 | Reise | 261/51 |
| 3,520,520 | 7/1970 | Cheskey | 261/51 |
| 3,596,645 | 8/1971 | Mennesson | 123/510 |
| 3,610,213 | 10/1971 | Gianini | 123/445 |
| 3,642,256 | 2/1972 | Phelps | 261/51 |
| 3,730,493 | 5/1973 | Elam | 261/70 |
| 3,778,038 | 12/1973 | Eversole et al. | 261/36 A |
| 3,807,707 | 4/1974 | Johnson | 261/34 R |
| 3,983,850 | 10/1976 | Stumpp et al. | 261/51 |
| 4,008,298 | 2/1977 | Quantz | 261/DIG. 38 |
| 4,034,730 | 7/1977 | Ayres et al. | 261/70 |
| 4,161,499 | 7/1979 | Floroff | 261/36 A |
| 4,186,707 | 2/1980 | Driggers | 261/69 R |
| 4,207,845 | 6/1980 | Semmler | 123/325 |

FOREIGN PATENT DOCUMENTS

| | | | |
|---|---|---|---|
| 1054430 | 1/1967 | United Kingdom | 123/325 |
| 1224610 | 3/1971 | United Kingdom | 123/325 |

*Primary Examiner*—Tim R. Miles

*Attorney, Agent, or Firm*—Connolly and Hutz

[57] ABSTRACT

A fuel control system for gasoline operated vehicles includes a metering device connected to the fuel line for controlling the rate of flow to the carburetor to permit a normal rate under ordinary driving conditions and an increased rate of flow under accelerated conditions with a filter being connected to the fuel line upstream from the metering device to prevent blockage of the main metering valve in the metering device and a second filter downstream from the metering device to act as a auxiliary reservoir.

16 Claims, 1 Drawing Figure

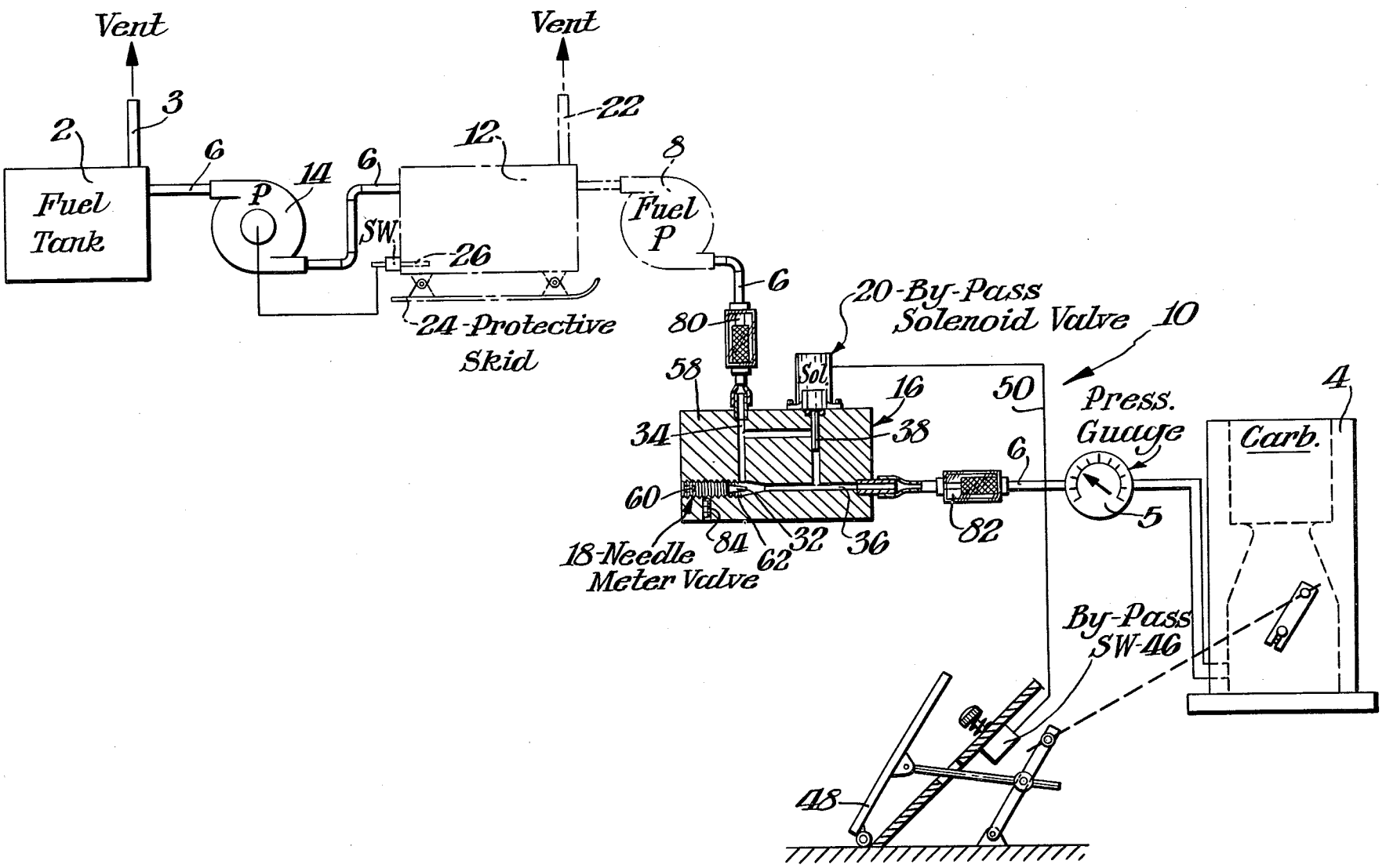
Carb.
4
Press. Gauge
5
10
By-Pass SW-46
20-By-Pass Solenoid Valve
50
6
82
16
38
36
32
62
84
18-Needle Meter Valve
60
34
58
80
6
8
Fuel P
22
Vent
12
26
24-Protective Skid
SW
6
14
P
6
3
Vent
2
Fuel Tank
48

FUEL CONTROL SYSTEM

CROSS-REFERENCE TO RELATED APPLICATION

This application is a continuation-in-part of application Ser. No. 197,695 filed Oct. 16, 1980, now abandoned.

BACKGROUND OF THE INVENTION

Parent application Ser. No. 197,695 filed Oct. 16, 1980 discloses a fuel control system for dramatically increasing the fuel efficiency for motor vehicles. That system includes a metering device for supplying gasoline to the carburetor in such a manner that a reduced rate of flow is supplied under normal driving conditions and an increased rate of flow is supplied during acceleration of the vehicle. The present invention is directed to modifications of that fuel control system.

SUMMARY OF INVENTION

An object of this invention is to provide a fuel control system of the above type which is adapted to prevent blockage which might otherwise occur in the metering device. A further object of this invention is to provide such a system which utilizes an auxiliary reservoir downstream from the metering device.

A still further object of this invention is to provide such a system which assures a proper rate of flow through the main valve of the metering device once the valve has been set.

In accordance with this invention, the fuel control system includes a metering device connected to the fuel line between the gasoline tank and the carburetor with the metering device including means for supplying a controlled rate of flow of gasoline therethrough under ordinary driving conditions and further including means for increasing the rate of flow during acceleration of the vehicle with a filter being mounted upstream from the metering device to filter out dirt and thereby prevent blockage in the metering device. In accordance with the invention, the system also includes a second filter downstream from the metering device to function as an auxiliary reservoir for the carburetor.

In accordance with a preferred practice of this invention, the main valve which is operative during normal conditions is a needle valve and stop means are provided to hold the needle valve in position once it has been set and thereby assure the proper rate of flow of fuel to the carburetor.

THE DRAWINGS

The fuel control system of this invention is illustrated in the single FIGURE.

DETAILED DESCRIPTION

The present invention is directed to a modification of the fuel control system described in parent application Ser. No. 197,695 filed Oct. 16, 1980, the details of which are incorporated herein by reference thereto. In general the fuel control system 10 which is the subject of the parent application includes a fuel storage tank 2 having a vent 3 with storage tank 2 feeding gasoline by means of pump 14 through fuel line 6. In accordance with that system, operating tank 12 is mounted to the fuel line 6 downstream from main tank 2 and is provided with its pump 8 to withdraw gasoline therefrom. Operating tank 12 includes a vent line 22 and a level sensing switch 26 for actuating pump 14 to assure that gasoline will be supplied from tank 2 when the level of gasoline in tank 12 is at a predetermined minimum. A protective skid plate 24 is also provided for operating tank 12. The system 10 also includes a metering device 16 which includes a main meter valve 18 and a by-pass valve 20 as later described. Fuel is fed from fuel line 6 into metering valve 16 through inlet line 34 and is then discharged from metering valve 16 through the portion of fuel line 6 downstream therefrom where it is fed into the float bowl of carburetor 4. Under ordinary operating conditions, the fuel is supplied to carburetor 4 through main meter valve 18. Under certain conditions, however, such as during acceleration when it is necessary to increase the supply of fuel, the fuel is additionally supplied through by-pass valve 20. The actuation of by-pass valve 20 (which is preferably a solenoid valve having extendable rod 38) may be accomplished by locating a suitable actuating by-pass switch 46 (connected by line 50 to valve 20) in the path of downward motion of gasoline pedal 48.

The drawing illustrates a further safeguard to system 10 wherein a pressure gauge 5 is mounted to fuel line 6 downstream from metering device 16 and upstream from carburetor 4 so as to provide a ready check that the proper amount of fuel pressure is maintained during feed of gasoline from the fuel pump 8 to the carburetor 4. The fuel feed pressure is easily adjusted by turning meter valve 18 in or out until the desired pressure is indicated on gauge 5.

The present invention includes a filter 80 upstream from inlet line 34 to filter out dirt and thereby prevent blockage which might otherwise occur in metering device 16 and particularly with respect to main meter valve 18.

The present invention also includes a second filter 82 downstream from metering device 16 which functions as a secondary reservoir similar to the reservoir in carburetor 4. The provision of this auxiliary reservoir provides the possibility of eliminating operating tank 12 and its fuel pump 8 although the invention may be practiced with the inclusion of both operating tank 12 and reservoir 82.

It is to be understood that the provision of filters 80, 82 is in addition to other filters which may conventionally be incorporated in the fuel system. In this regard, one of the advantages of the fuel control system of this invention is that it lends itself to adaptation to existing fuel systems in motor vehicles by a simple mounting of, for example, the metering device (and the operating tank 12 and its pump 8, where needed) to the fuel line of the existing system. Accordingly, while the existing fuel system to which the invention is adapted may already include filters, filters 80 and 82 are additional filters specifically intended to function in the manner indicated above.

In the preferred form of this invention, main meter valve 18 is a needle valve which includes a threaded rod 60 threadably engaged with an internally threaded portion of passage 62 so that the pointed end 32 of rod 60 may be adjusted with respect to the junction of inlet line 34 and outlet line or passageway 36 so as to control the amount of flow from inlet line 34 to outlet line 36. The drawback with using such a needle valve, however, is that vibrations caused by the bumping of the vehicle on the road might tend to cause the threaded rod 60 to rotate somewhat and back out or otherwise alter the intended setting. The present invention minimizes such backing off or setting alteration. This is accomplished by the provision of a locking mechanism to hold threaded rod 60 in position once it has been adjusted to the desired location. As shown in the drawing, the locking mechanism is in the form of a screw or bolt 84 which extends through a threaded bore in mounting block 58 perpendicular to threaded passage 62. In operation, locking member 84 would be retracted or unscrewed out of passage 62 so that threaded rod 60 can be manipulated to the desired setting. Locking member 84 is then moved inwardly toward passage 62 until it engages threaded rod 60. By so engaging locking member 84 with threaded rod 60 any tendency of threaded rod 60 to alter its position is prevented.

If desired, the outer end of locking member 84 could be slotted to accept the conventional screwdriver. As a further feature of this invention, however, the outer end would have a special configuration to require a special tool for its manipulation such as an Allen wrench so that locking member 84 can be easily manipulated. This feature would act as a tamperproof feature to prevent unauthorized adjustments of the needle valve 18.

Although the invention has been particularly described with respect to one form of locking mechanism which is particularly suitable for needle valve, the invention may be practiced with other forms of locking mechanisms and other forms of valves. Needle valves, however, are preferred for economy. Similarly, any suitable in-line fuel filter may be used for filters 80, 82 such as manufactured by Purolator, Fram, etc., or filter 82 may simply be any form of receptacle capable of functioning as an auxiliary reservoir.

What is claimed is:

1. In a fuel control system for gasoline-operated motor vehicles having a main storage tank and a fuel pump connected in the fuel line between the main storage tank and the float bowl of a carburetor for feeding gasoline to the carburetor, the improvement being a control system mounted to said fuel line between said fuel pump and said carburetor whereby said control system is adapted to be installed into already existing systems of motor vehicles, said control system including an operating tank mounted to said fuel line downstream from and in flow communication with said main storage tank, vent means for said operating tank, metering means in said fuel line downstream from said operating tank for controlling the rate of fuel flowing to said carburetor, said metering means including a main valve for providing a fixed rate of flow to said carburetor and a selectively operated by-pass valve for providing an increased rate of flow to said carburetor, said main valve and said by-pass valve being mounted in a common housing, said common housing having an upstream inlet line and a downstream outlet line, connecting means connecting said inlet line to an upstream portion of said fuel line between said fuel pump and said housing, and connecting means connecting said outlet line to a downstream portion of said fuel line between said housing and said carburetor.

2. The system of claim 1 wherein said main valve is adjustable for adjusting said fixed rate of flow.

3. The system of claim 1 including operator actuating means connected to said by-pass valve whereby the vehicle operator may actuate the opening of said by-pass valve.

4. The system of claim 3 wherein said actuating means comprises electrical control means connected to said by-pass valve and actuated by the depression of the vehicle gasoline pedal to a predetermined position.

5. The system of claim 4 wherein said main valve is adjustable for adjusting said fixed rate of flow.

6. The system of claim 5 wherein said main valve is a needle valve, and said by-pass valve being a solenoid valve.

7. The system of claim 6 wherein a second fuel pump is mounted between said main storage tank and said operating tank for feeding fuel from said main storage tank to said operating tank, said operating tank being a flat elongated tank of substantially lesser capacity than the capacity of said main storage tank, a protective skid plate being mounted under said operating tank, and vent means for said storage tank.

8. The system of claim 7 wherein said solenoid valve is normally in an open position and moves to its closed position upon the turning on of the ignition, and a sensor in said operating tank for actuating said second fuel pump when the fuel level in said operating tank drops to a predetermined level to feed fuel from said main storage tank to said operating tank.

9. A method of modifying an existing fuel system of a motor vehicle having a main storage tank and an operating tank in flow communication by means of a fuel line to the float bowl of a carburetor comprising mounting a metering device including a main valve and a by-pass valve to the fuel line downstream from the operating tank, the metering device having a common housing for the main valve and the by-pass valve with the common housing having an upstream inlet line and a downstream outlet line, connecting the inlet line to an upstream portion of the fuel line between the fuel pump and the housing, connecting the outlet line to a downstream portion of the fuel line between the housing and the carburetor, providing a fixed rate of flow through the main valve to the carburetor and selectively providing an increased rate of flow from the by-pass valve under acceleration conditions to the carburetor.

10. The method of claim 9 wherein the by-pass valve is a solenoid valve and including the step of electrically connecting the solenoid valve to an actuator disposed in the path of motion of the gasoline pedal for actuating the solenoid valve when the gasoline pedal is depressed to a predetermined position.

11. The method of claim 10 wherein the main valve is adjustable and including the step of setting the adjustment of the main valve to set the fixed flow rate.

12. The method of claim 10 wherein the solenoid valve is normally in an open position and including the step of closing the solenoid valve upon turning on the ignition.

13. The method of claim 9 including mounting a vented operating tank to the fuel line downstream from and in flow communication with the main storage tank.

14. The method of claim 13 wherein the main storage tank is connected by a secondary flow line to an emission filter and including the step of venting the main storage tank by disconnecting the secondary flow line from the emission filter.

15. The method of claim 13 wherein the operating tank is of substantially lesser capacity than the main storage tank and including the steps of mounting a second fuel pump between the main storage tank and the operating tank, and actuating the second fuel pump by sensing when the fuel has dropped to a predetermined level in the operating tank to feed additional fuel from the main storage tank to the operating tank.

16. The method of claim 15 including mounting a protective skid plate under the operating tank.

* * * * *